US007168639B2

(12) United States Patent
Craft

(10) Patent No.: US 7,168,639 B2
(45) Date of Patent: Jan. 30, 2007

(54) METHOD AND APPARATUS FOR REDUCING TIRES

(76) Inventor: Thomas H. Craft, 21980 Coloma Dr., Palo Cedro, CA (US) 96073

( * ) Notice: Subject to any disclaimer, the term of this patent is extended or adjusted under 35 U.S.C. 154(b) by 0 days.

(21) Appl. No.: 11/298,227

(22) Filed: Dec. 9, 2005

(65) Prior Publication Data

US 2006/0091248 A1 May 4, 2006

Related U.S. Application Data

(62) Division of application No. 10/717,754, filed on Nov. 20, 2003, now abandoned.

(60) Provisional application No. 60/429,961, filed on Nov. 26, 2002.

(51) Int. Cl.
*B02C 19/00* (2006.01)

(52) U.S. Cl. ..... 241/3; 241/242; 241/DIG. 31; 241/223

(58) Field of Classification Search ..... 241/3, 241/30, 242, 243, 294, 295, DIG. 31, 300, 241/223

See application file for complete search history.

(56) References Cited

U.S. PATENT DOCUMENTS

| | | | | |
|---|---|---|---|---|
| 4,927,088 | A * | 5/1990 | Brewer | 241/223 |
| 5,402,948 | A * | 4/1995 | Kaczmarek | 241/73 |
| 5,904,305 | A * | 5/1999 | Kaczmarek | 241/79.1 |
| 5,950,945 | A * | 9/1999 | Schaller | 241/189.1 |
| 2005/0116074 | A1 * | 6/2005 | Kusak | 241/195 |

* cited by examiner

*Primary Examiner*—Mark Rosenbaum

(57) ABSTRACT

A method and apparatus for reducing vehicle tires includes a feed mechanism for transferring flattened tire treads into a shearing assembly which includes a rotating shear assembly. The shear assembly is comprised of a rotating arbor supporting a stack of a plurality of cutting plates having cutting inserts extending therefrom in a variable helical pattern. The inserts rotate past an anvil edge, and the sharp edges of the inserts shear the infeeding edge of the tire tread. The inserts are replaceable, and the spacing of the cutting head and anvil edge is variable to optimize the shearing action.

5 Claims, 8 Drawing Sheets

METHOD AND APPARATUS FOR REDUCING TIRES

CROSS-REFERENCE TO RELATED APPLICATIONS

This application claims the priority filing date of Provisional Application No. 60/429,961, filed Nov. 26, 2002; and, is a Divisional Application of the parent Parent application Ser. No. 10/717,754, filed Nov. 20, 2003, now abandoned.

FEDERALLY SPONSORED RESEARCH

Not applicable.

SEQUENCE LISTING, ETC ON CD

Not applicable.

BACKGROUND OF THE INVENTION

1. Field of the Invention

The present invention relates to a system for reducing tires to small particulate material and, more particularly, to an apparatus for reducing tires using a shear technique.

2. Description of Related Art

Tires are typically made of rubber or rubber-like material, and when the tire tread is worn, or when the tire has sustained some damage, requiring a discarding of the tire, a serious problem arises as to proper disposal. Millions of tires are discarded annually and because of their bulk and lengthy life, even under extreme weather or burial conditions, they create an unsightly and massive eye-sore, and a need for extremely large storage areas. On some occasions, the collection of tires will catch on fire and burn for many months or even longer, further contributing to environmental concerns.

Tire components (rubber, rubber-like substances, reinforcing fiber, steel wire, etc.) have been engineered to exhibit durability and longevity in extremely hostile environments, such as severe temperature changes, exposure to salt and other corrosive chemicals, continuous flexure, abrasion and ablation, UV exposure, countless cycles of wetting and drying, and the like. The very factors that have created reliable and tough tires have, ironically, mitigated against any easy method for disposing of worn or damaged tires.

Many attempts have been made to solve this problem, including the use of shredders, cutters, etc., but none of these prior art devices have proven satisfactory for a number of reasons. These include the large required size of the apparatus, the power requirements, and the inability to economically and reliably produce small particulate fragments at a reasonable cost. Typical prior art apparatus generates a great amount of heat, creating the hazard of potential dust explosion and requiring cooling measures such as liquid spray heads to remove the heat and prevent fire or explosion. The introduced liquid then presents a further material handling problem for the resulting slurry.

BRIEF SUMMARY OF THE INVENTION

The present invention generally comprises a method and apparatus for reducing worn or damaged vehicle tires for disposal or recycling of the tire materials. The invention makes use of a shear technique and preferably feeds the tread portion of the discarded tire through rollers and into an apparatus where the tire is cut into pieces of one-quarter inch, one-eighth inch, or even smaller; e.g., a powder form, through a shearing action.

The tire to be reduced is first cut so that the circumference of the tire is no longer continuous. The bead portions of the tire are then cut away from the tread portion and the latter is fed between upper and lower roller assemblies, at least one of which is pressure loaded so as to exert a flattening pressure on the normally curved tread portion of the de-beaded tire. Rotation of the rollers causes the tread to move towards the shear mechanism of the present invention. Ground rubber is removed by vacuum and discharged onto a magnetic-driven drum that removes steel particles from the rubber granules or pieces. The rubber granules may then pass through a screen classifier which sizes or grades the particulate material.

At the end of the feed mechanism and just before the cutting head there is a stationary anvil, which is attached to the feed mechanism. The tire is fed up to a rotating cutting head and sheared off at the point of contact between the anvil and insert cutters of the cutting head. At this point, the tire is cut, not ground down like most prior art tire shredders. Very little heat is produced in the reduction of the tire, so no cooling agent is necessary. This makes the invention cost effective and eliminates the mess and material handling problems created by the cooling agent.

The cutting head is comprised of a variable number of cutting plates mounted as a stack on a rotating arbor. Each cutting plate has a variable number of insert cutters. The cutting inserts have multiple cutting edges and can be rotated and changed as needed. Each cutting insert is attached to the cutting plate by a positive mechanical pin. The cutting plate is formed to allow each cutting insert to have an individual seat which in turn houses the positive mechanical pin. The number of cutting plates and the number of insert cutters vary in accordance with the size of the tire reduction unit. The cutting plates are positioned and held on the cutting head by a keyway. By adjusting the position of the keyway on the individual cutting plates, a helix pattern defined by the insert cutters on the adjacent plates may be selectively varied to produce the optimum shearing effect. The helix pattern determines that all of the rotational force of the arbor is applied by only a few of the cutting inserts to the tire piece at any one instant, so that the cutting inserts cut through the leading edge at the anvil, rather than grinding or abrading the tire piece, whereby heat generation is minimized. Also, the impact point of the cutting inserts progresses laterally across the leading edge of the tire piece as the arbor rotates.

The feed mechanism is adjustable to allow the anvil to be adjustably spaced with respect to the cutting head (6). This feature permits adjustment of the tire reduction unit to a desired tolerance between the anvil and the cutting head. The smaller the gap between the anvil and the cutting head, the smaller the rubber particles which will be produced.

It will be understood that the particulate material created by this apparatus can be used for many commercial applications such as a fill material in numerous composition. Even if the particulate material is not reused, it presents a better opportunity for disposal compared to disposing of the complete, intact tire tread. (The reduced tire particulates occupy far less volume than an intact tire.) It should also be noted that tires may have steel reinforcement, and the present invention incorporates a mechanism for separating this metal from the rubber after the de-beading or shearing operation.

DETAILED DESCRIPTION OF THE INVENTION

The present invention generally comprises a method and apparatus for reducing worn or damaged tires for disposal or recycling of the tire materials. The method of the invention will be described in concert with the description of the apparatus.

Figure 1:
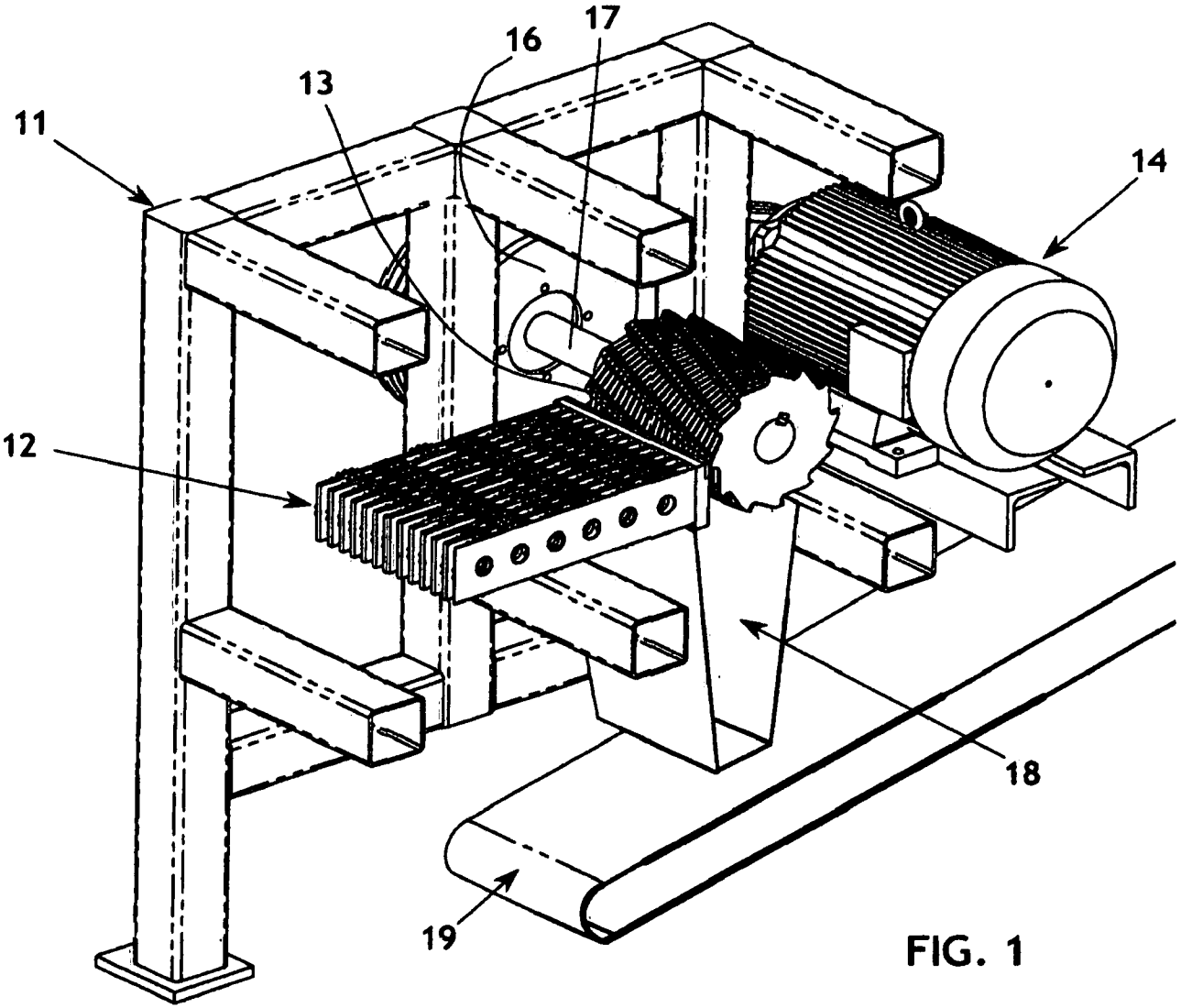
FIG. 1 is a perspective view of the apparatus of the invention (with housing removed) for reducing tires to particulate material.

With regard to FIG. 1, the tire reducing apparatus includes a structural framework 11 that supports the dynamic components as well as a housing or shroud for containing the dust and particulates generated by the dynamic components. The framework 11 supports a feed mechanism 12 (only the lower half shown in FIG. 1 for clarity) that is disposed adjacent to a cutting head assembly 13, the feed mechanism being adapted to drive tire tread pieces and the like into engagement by the cutting head assembly. The feed mechanism 12 is preferably, but not necessarily, driven by a hydraulic motor feed by a hydraulic pump. A variable speed electric motor 14 is connected through a belt or chain drive to a pulley wheel 16 which is secured to the drive shaft 17 of the cutting head assembly 13. Thus the motor 14 may drive the cutting head at a selected rotary speed to reduce tire tread pieces transferred by the feed mechanism to the cutting head 13. The resulting particulates are received by a chute 18 extending below the cutting head 13 and directed to a conveyor belt 19 for subsequent processing.

Figure 2:
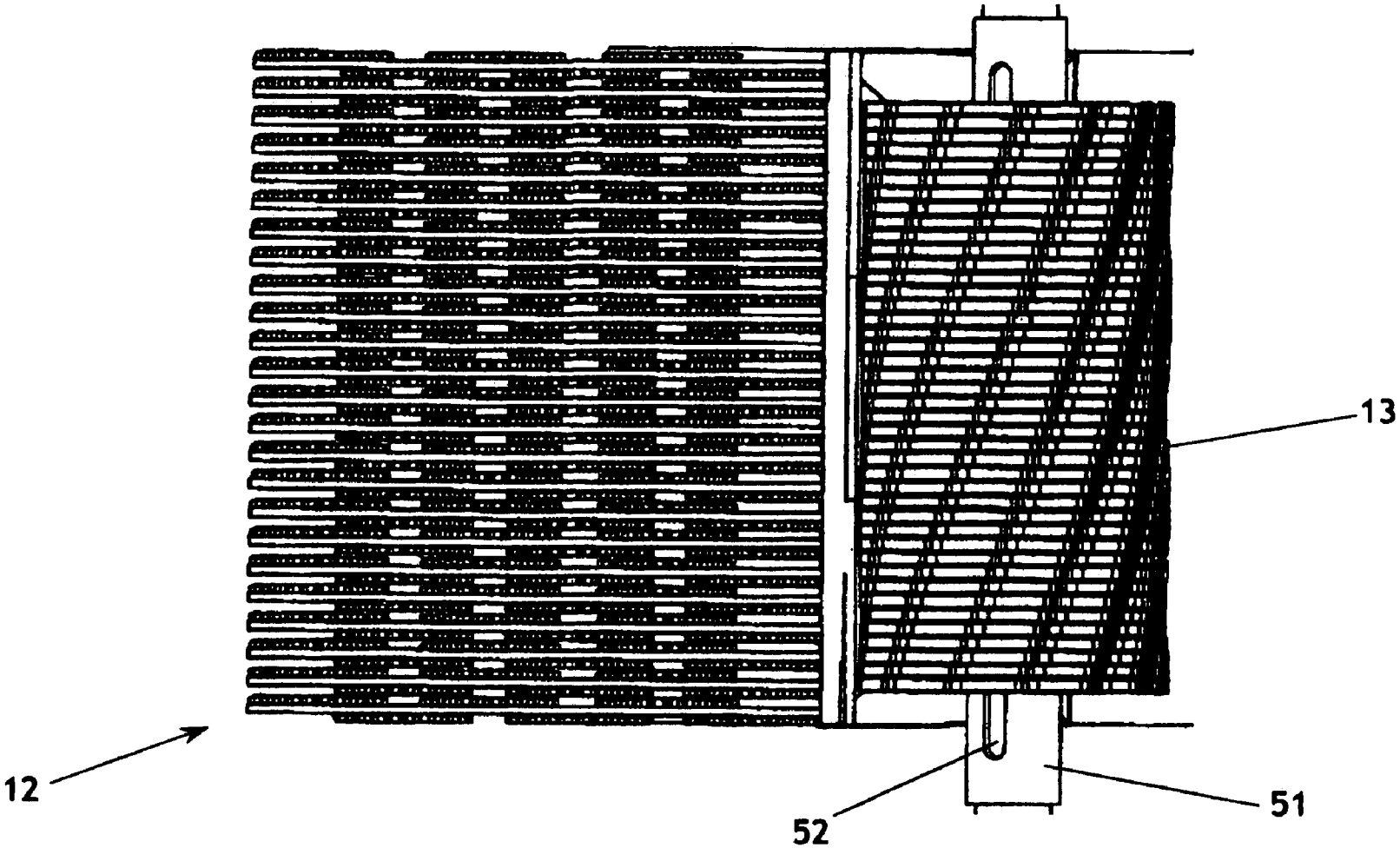
FIG. 2 is a plan view of the feed mechanism and the cutting head of the tire reducing apparatus of the invention.
Figure 3:
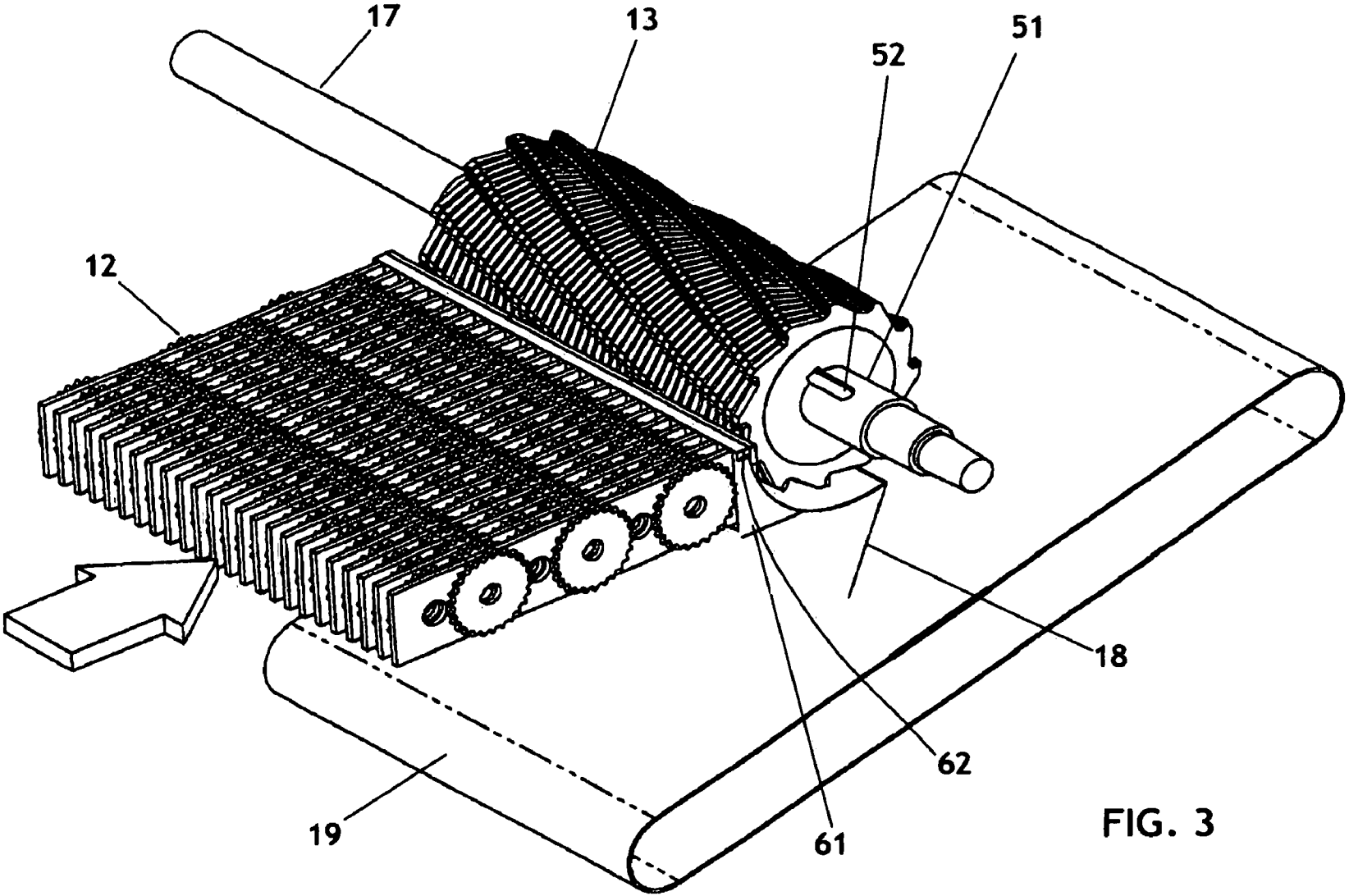
FIG. 3 is a perspective view of the feed mechanism, cutting head, and conveyor belt of the tire reducing apparatus of the invention.
Figure 4:
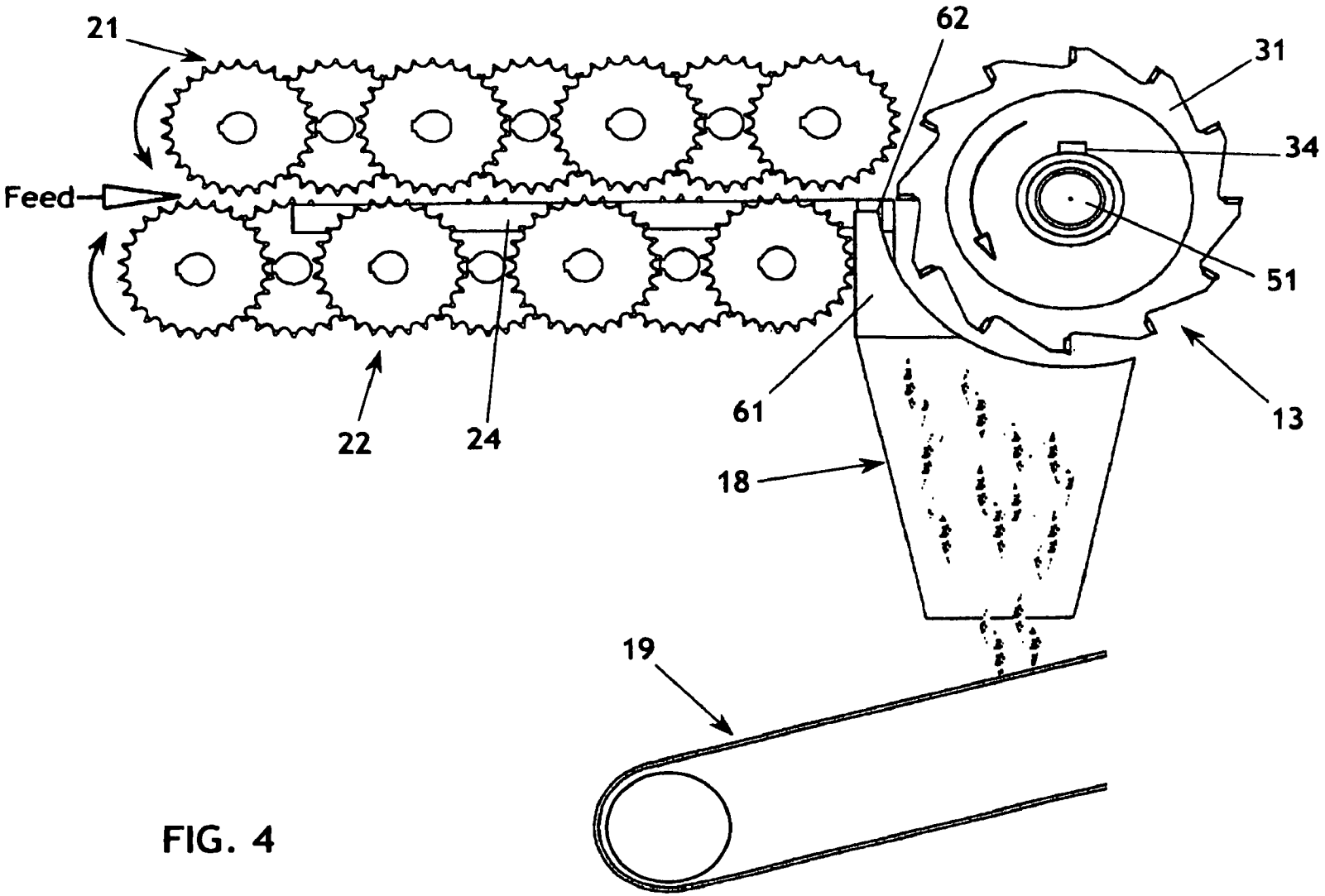
FIG. 4 is a side elevation of the feed mechanism, cutting head, anvil, and conveyor belt of the tire reducing apparatus of the invention.

With regard to FIGS. 2–4, the feed mechanism includes upper and lower assemblies 21 and 22, each supporting toothed wheels, the toothed wheels of the assemblies 21 and 22 being vertically separated a distance that is minimally sufficient to define a feed path through which tire tread pieces and the like may be transferred. The lower assembly 22 includes an open framework feed bed 24, to support the tire pieces, through which the toothed wheels protrude to engage the tire pieces. The toothed wheels of the upper and lower assemblies are driven in respective counter-rotation, as shown in FIG. 4, to drive the tire pieces in the feed direction toward the cutting head assembly 13.

Figure 5:
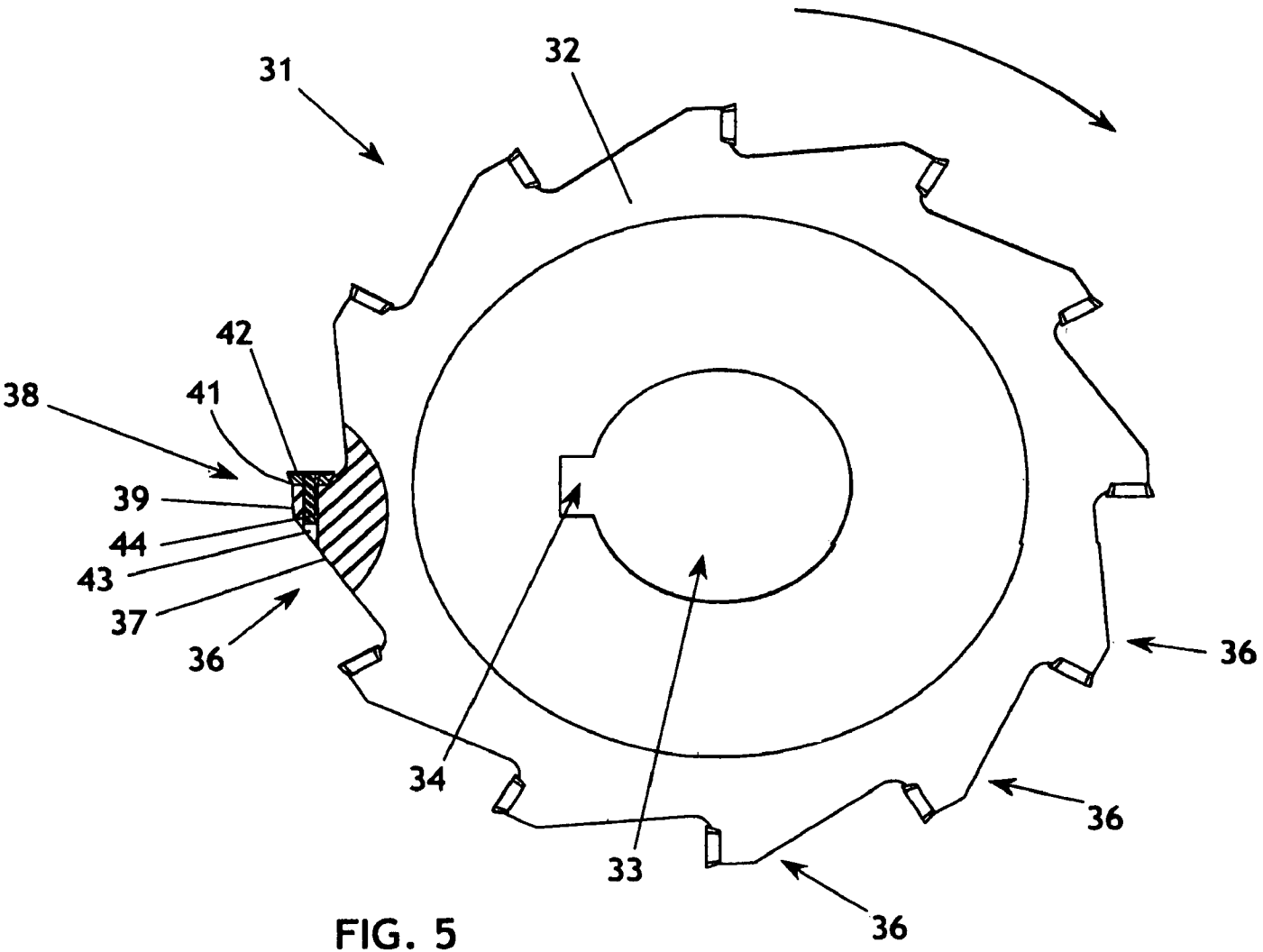
FIG. 5 is a partially cutaway plan view of a cutting plate of the cutting head assembly of the invention.
Figure 6:
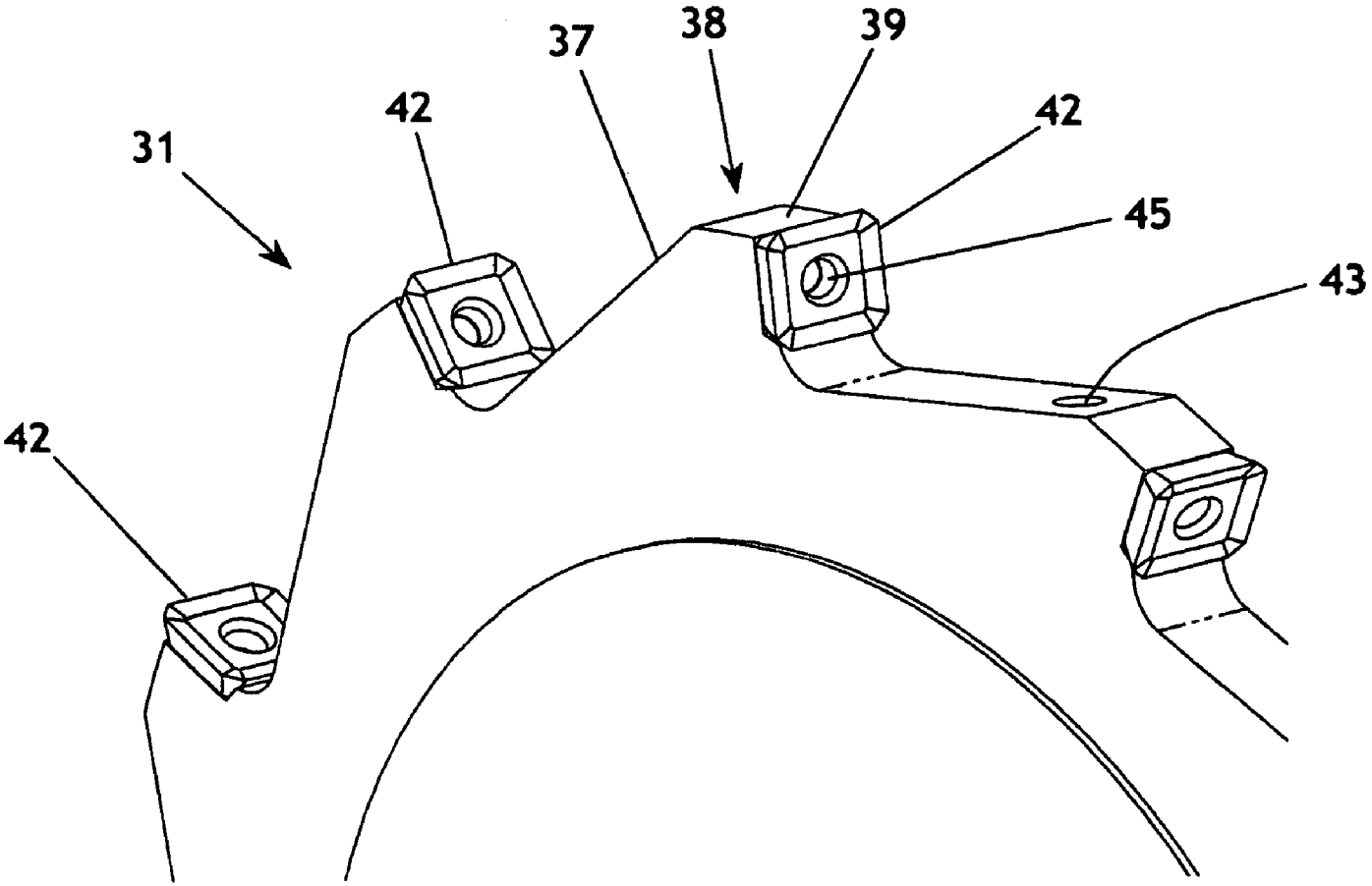
FIG. 6 is an enlarged partial perspective view of a cutting plate of the cutting head assembly of the invention.

The cutting head assembly 13 is comprised of a plurality of cutting plates, a representative one being shown in FIGS. 5 and 6. Each cutting plate 31 comprises a circular disk 32 having a central bore 33 extending therethrough and a keyway 34 machined or otherwise formed in the ID of the bore 33. A plurality of scallop-like projections 36 extend generally radially outwardly from the periphery of the disk 32, each projection including a ramp portion 37 extending obliquely outwardly to a lug portion 38. Each lug portion 38 is defined by an outer peripheral surface 39 extending generally in a circle of constant diameter centered with the bore 33, the surface 39 forming a vertex with a mounting surface 41 that extends generally radially with respect to the bore 33.

Joined to each lug portion 38 is a cutting insert 42 which is secured to the mounting surface 41. Each cutting insert 42 is a generally rectangular solid formed of hardened carbide or the like that flares slightly outwardly from the mounting surface 41 to define sharp outer edges. Each cutting insert is provided with a central tapered hole 45 extending therethrough. A mounting hole 43 extends normally through the mounting surface 41 and through the lug portion 38 to the surface 37. A pin 44 having a flared head extends through the hole 45 of each cutting insert 42 and is press fit or otherwise positively secured in the mounting hole 43. The flared head of the pin 44 is recessed from the outer surface of the cutting insert, so that the cutting edges of the insert are prominent. Note also that the cutting edges of the inserts 41 extend radially outwardly from the cutting plate farther than the outermost lug surface 39, whereby the cutting edges of the inserts are disposed to contact the tire work piece as the cutting plate rotates about its central axis. Note also that each cutting insert has multiple cutting edges and, when the radially outermost edge becomes worn, the insert may be rotated to present a fresh, sharp cutting edge, or the entire insert may be replaced.

The plurality of cutting plates 31 are arranged in a coaxial stack and assembled to an arbor 51 that extends axially from the shaft 17, the arbor extending through the central holes 33 of the cutting plates. The arbor includes a keyway channel 52 (see FIGS. 2 and 3) extending longitudinally in the circumferential surface thereof and dimensioned to engage a key, such as a woodruff key or the like, that also engages the keyway 34 of each cutting plate 31. Thus the cutting plates are rotationally immobilized on the arbor 51.

Additionally, the cutting plates 31 vary slightly in the angular disposition of each keyway 34 about the axis of the central holes 33 of the plates 31. This angular variation is selected so that each cutting plate is angularly offset a predetermined, angular extent that is progressive with respect to the adjacent cutting plates, whereby the lugs 38 and their cutting inserts 42 are likewise angularly offset. As a result, the cutting inserts 42 of the cutting plates 31 that form the cutting head 13 are arranged in a predetermined pattern about the outer periphery of the cutting head 13 to define the optimum cutting pattern for the material being reduced. The factors that enter into the determination of the optimum cutting pattern may include the thickness of the tire tread, the type of fiber reinforcement (Nylon®, Aramid®, steel, or the like), and the type of rubber (density, degree of cross-linking, etc.).

Figure 7:
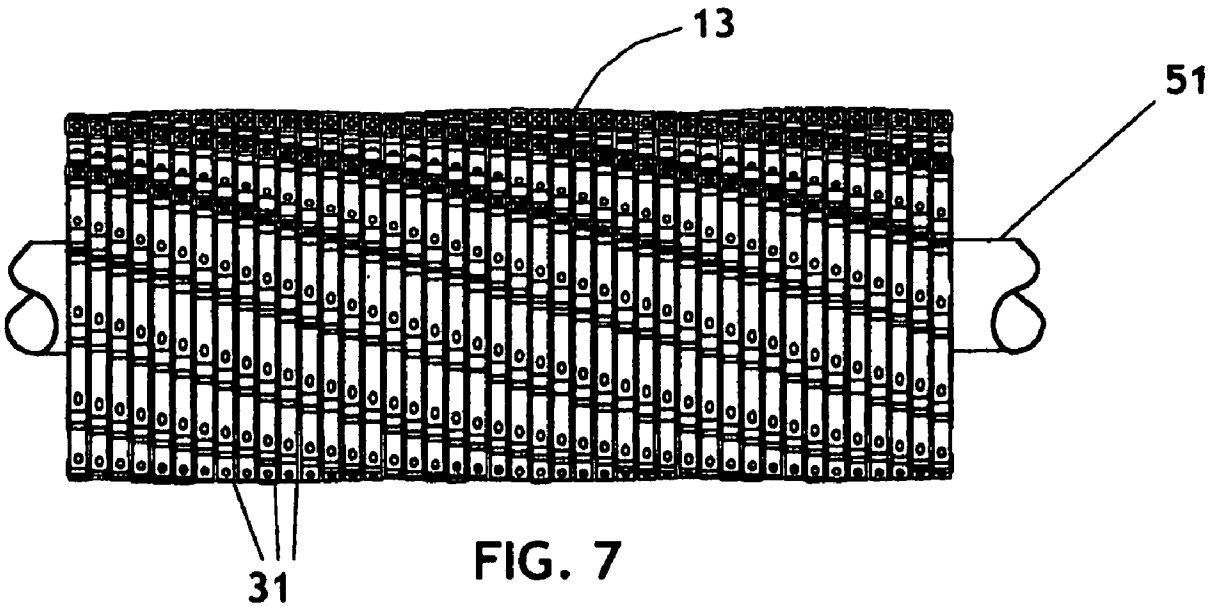
FIG. 7 is a plan view of the cutting head assembly, showing one helical arrangement of the cutting plates.
Figure 8:
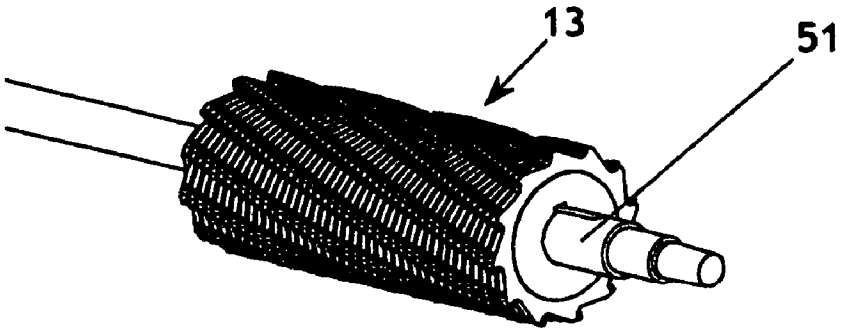
FIG. 8 is a perspective view of the cutting head assembly shown in FIG. 7.
Figure 9:
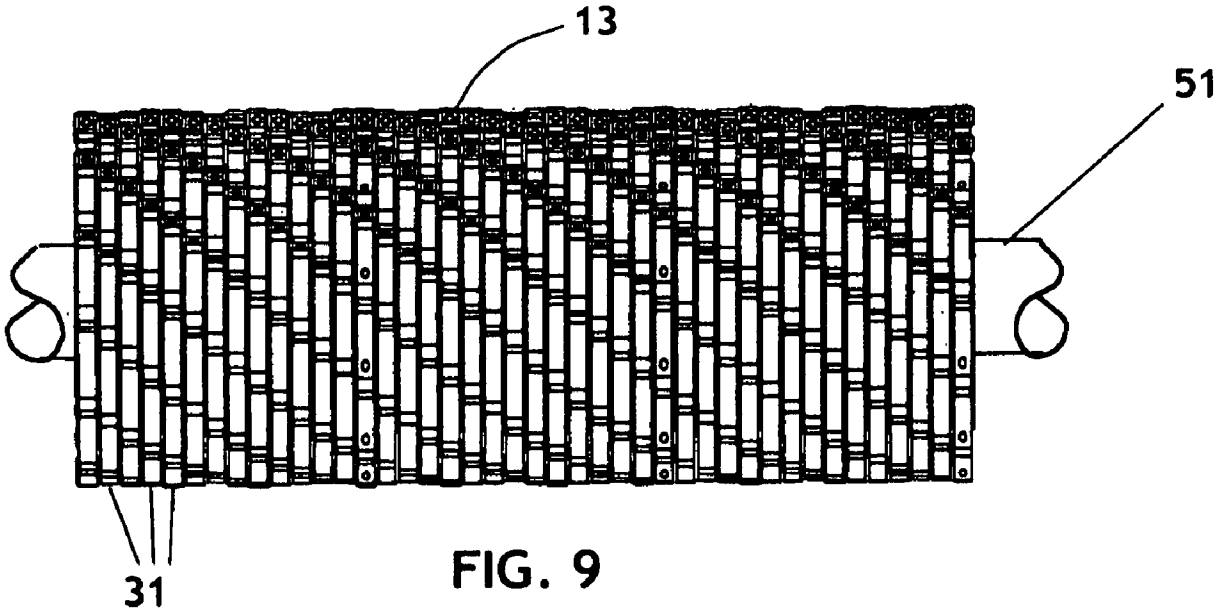
FIG. 9 is a plan view of the cutting head assembly, showing another helical arrangement of the cutting plates.
Figure 10:
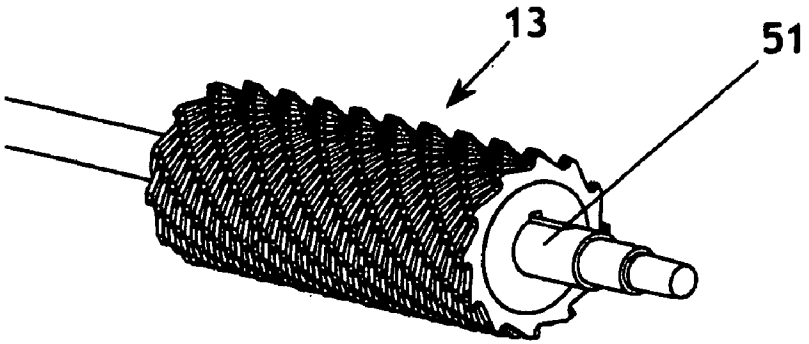
FIG. 10 is a perspective view of the cutting head assembly shown in FIG. 9.

Thus, for comparative examples, the cutting plates 31 may be angularly offset to a lesser progressive degree to define a pattern of cutting inserts that is described as multiple helical paths extending in a shallow progressive angle about the cutting head, as shown in FIGS. 7 and 8; or in multiple helical paths extending in a more acute progressive angle about the cutting head, as shown in FIGS. 9 and 10. The former enables a relatively greater number of cutting inserts 42 to shear the leading edge of the tire material at any instant, thus reducing the force applied to each cutting insert as it makes contact with the tire material; the latter presents a relatively lesser number of cutting inserts 42 to shear the leading edge of the tire material and produces greater shearing force for each insert as it impacts the tire material.

With regard to FIGS. 3 and 4, another salient feature of the invention is the provision of an anvil 61 supported by the frame 11 and disposed between the feed mechanism 12 and the cutting head 13. The anvil 61 includes a structural member extending laterally across the feed path of the feed mechanism and having an anvil edge 62 extending parallel to the periphery of the cutting head 13 and spaced apart therefrom a small, selectively variable distance. The anvil edge 62 is formed of hardened tool steel or the like and is disposed to support the leading edge of the tire piece being processed, as it engages the cutting head 13. The support of the anvil edge 62 is significant in enabling the cutting inserts of the plates 31 to shear through the leading edge of the infeeding tire piece in a scissor-like action and prevent abrading and grinding actions that would otherwise lead to greater heat generation.

The apparatus also includes a vacuum system for uptake of dust-laden air within the housing of the apparatus, and filters or the like for suppression of dust and dirt. These components are common in the prior art and need not be shown in particular herein.

It may be noted that there are several factors in the construction of the apparatus that may be selectively varied to accommodate the tire material being reduced. These factors include:

1) the number cutting inserts provided on each cutting plate;
2) the number of cutting plates used to define the cutting head, determining the width of the cutting head;
3) the helical pattern of cutting inserts in the cutting head;
4) the spacing of the cutting head from the anvil edge;
5) the speed at which the motor 14 drives the cutting head 13;
6) the rate at which the tire pieces are fed into the cutting head.

The first three factors are set during the machine setup stage, whereas the latter three factors may be operator-adjusted as the machine is in use to create the optimum particle size and cutting speed in accommodation to the tire material being processed. In the embodiment shown herein, the cutting head 13 is comprised of cutting plates having a diameter of about 10 inches with 12 cutting inserts per plate, and the width of the cutting head is about 2 feet. The spacing of the anvil edge from the cutting head inserts is about 0.090–0.010 inches. (The closer the spacing, the finer is the resulting tire fragments.) The motor 14 is approximately 50 horsepower, as compared to equivalent prior art devices that employ motors up to 10 times this power. It should be noted that not only is the motor much smaller than prior art devices, but the entire apparatus is compact and efficient, so that it is capable of being installed widely at numerous fire recovery locations, rather than the enormous prior art devices that are suitable only for large centralized tire processing facilities.

The method of the invention includes preparing the tire pieces by first cutting through the torus-shaped tire parallel to the axis of the torus, and thereafter cutting away the bead portions from the tread portion. The latter is then fed into the feed mechanism endwise, the upper and lower feed mechanisms flattening the tread portion as it is driven into the cutting head in a flat, endwise engagement. The resulting tire fragments and crumbs are collected on the conveyor 19 and transferred to a magnetic separator, if steel filament reinforcement is present, or to a storage bin for subsequent processing.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A method for reducing a vehicle tire tread to crumb rubber in a one pass operation, including the steps of:

providing a rotating cutting head having a plurality of cutting inserts with multiple shearing edges protruding from the circumference of said cutting head;

providing a feed mechanism for flattening the tire tread portion and feeding the tire tread portion endwise into said rotating cutting head;

providing an anvil edge between said feed mechanism and said cutting head to support the infeed end of said tire tread as said cutting inserts rotate on said cutting head and shear through said tire tread; and, collecting the resulting tire crumb rubber.

2. The method for reducing a vehicle tire tread of claim 1, has an adjustable feed mechanism which feeds the tire treads into a rotating cutting head at a desired rate for each thickness of tire tread.

3. The method for reducing a vehicle tire tread of claim 1, further including varying the spacing of said anvil edge from said cutting head to vary the size of the resulting tire crumb rubber.

4. The method for reducing a vehicle tire tread of claim 1, further including the step of arranging said cutting inserts in a pattern of multiple helical paths of shallow progressive angles about said circumference of said cutting head.

5. The method for reducing a vehicle tire tread of claim 4, further including the step of selectively changing said shallow progressive angles of said multiple helical paths.

* * * * *